US006176162B1

(12) United States Patent
Ludwig et al.

(10) Patent No.: US 6,176,162 B1
(45) Date of Patent: Jan. 23, 2001

(54) POWER-DRIVEN SCREWDRIVER WITH REMOVABLE DEPTH STOP

(75) Inventors: Manfred Ludwig, Landsberg/Lech; Wolfgang Schreiber, Stuttgart, both of (DE)

(73) Assignee: C. & E. Fein GmbH & Co., Stuttgart (DE)

( * ) Notice: Under 35 U.S.C. 154(b), the term of this patent shall be extended for 0 days.

(21) Appl. No.: 09/388,720

(22) Filed: Sep. 2, 1999

(30) Foreign Application Priority Data

Sep. 30, 1998 (DE) ..... 198 45 018

(51) Int. Cl.[7] ..... B25B 23/157
(52) U.S. Cl. ..... 81/473; 81/467
(58) Field of Search ..... 81/52, 54, 473, 81/474, 467, 429; 173/176, 178; 192/56.1, 150

(56) References Cited

U.S. PATENT DOCUMENTS

| | | | | |
|---|---|---|---|---|
| 2,765,059 | | 10/1956 | Amtsberg . | |
| 3,115,230 | | 12/1963 | Creighton et al. . | |
| 4,631,992 | * | 12/1986 | Eckman | 81/470 |
| 4,655,103 | | 4/1987 | Schreiber et al. . | |
| 5,094,133 | * | 3/1992 | Schreiber | 81/474 |
| 5,356,350 | * | 10/1994 | Schreiber | 475/153 |
| 5,775,186 | * | 7/1998 | Rahm | 81/474 |
| 5,881,613 | * | 3/1999 | Han | 81/429 |

FOREIGN PATENT DOCUMENTS 39 33913 A1 4/1991 (DE) .

OTHER PUBLICATIONS

International Search Report dated Mar. 28, 2000.

* cited by examiner

*Primary Examiner*—Timothy V. Eley
*Assistant Examiner*—Dung Van Nguyen
(74) *Attorney, Agent, or Firm*—Cummings & Lockwood

(57) ABSTRACT

A screwdriver is disclosed, comprising a removable depth stop which selectably either, when equipped with the depth stop, allows noiseless shutoff or, with the depth stop removed, allows torque-dependent shutoff, without any chattering occurring when the machine continues to run. To this end, an adjustable torque-dependent release clutch is combined with an entrainment clutch of known type, which is additionally preceded by a disconnect clutch, a locking means being provided in order to hold a throwout ring, which forms one of the two elements of the disconnect clutch, in a predetermined position under load. In this way, noiseless operation is ensured after release, both when working with the depth stop and in the case of torque-dependent shutoff, with the depth stop removed.

21 Claims, 5 Drawing Sheets

POWER-DRIVEN SCREWDRIVER WITH REMOVABLE DEPTH STOP

BACKGROUND OF THE INVENTION

Figure 1:
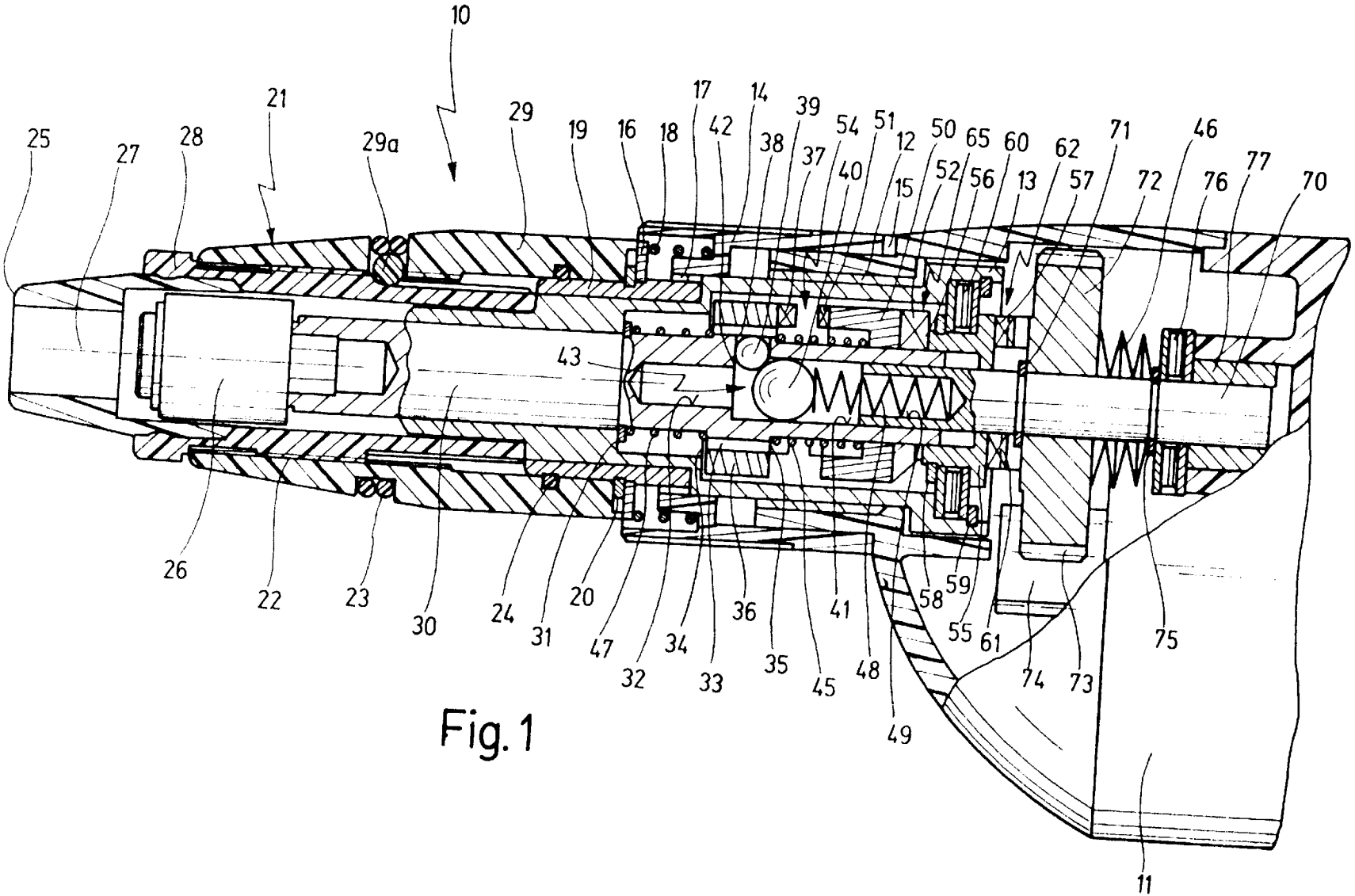

The present invention relates to a power-driven screwdriver comprising:

- a housing on which a depth stop can be fastened;
- a tool drive shaft, displaceable relative to the depth stop in the direction of its rotation axis, on which a tool receptacle is held;
- a drive shaft;
- a drive gear, received in rotatable and axially displaceable fashion on the drive shaft, which is motor-driven;
- an intermediate ring that is mounted rotatably on the drive shaft and has a first side facing toward the drive gear, and a second side;
- a cam ring that is mounted rotatably on the tool drive shaft and has a first side facing toward the intermediate ring, and a second side;
- first cam elements on the drive gear that coact with associated second cam elements on the first side of the intermediate ring in order to form a first cam clutch;
- third cam elements on the second side of the intermediate ring that coact with associated cam elements on the cam ring in order to form a second cam clutch;
- first catch elements on the intermediate ring that coact with associated second catch elements on the cam ring and form, together with the third and fourth cam elements, an entrainment clutch; and
- a first spring element for noiseless disconnection upon release of the release clutch.

A screwdriver with depth stop of this kind is known from U.S. Pat. No. 4,655,103, the disclosure of which is fully incorporated by reference.

With the known screwdriver, a screw can be driven into a surface to a driving depth preset with a depth stop. When the depth stop encounters the surface, this initiates shutoff of a clutch with which a largely noiseless shutoff is accomplished. A motor-driven drive gear, which together with an idler gear arranged in axially movable fashion forms a first cam clutch, is provided for this purpose. The idler gear coacts, on its other side facing the tool carrier, with a further clutch element, the oblique cam surfaces of the associated elements forming a second cam clutch. In addition, catch elements in the form of straight, axially parallel flanks, by way of which, when a certain baseline torque occurs, the clutch element joined to the tool receptacle is entrained by the intermediate clutch element, are provided on the idler gear and on the second clutch element. In addition, a compression spring by way of which the idler gear is preloaded in the direction toward the tool receptacle is arranged between the drive gear and the idler gear.

In operation, first the depth stop is set to the desired driving depth and then the tool carrier with its tool is placed onto, for example, a screw that is to be driven in, and pressed down. As a result, all three clutch elements come into engagement with one another, so that initially the torque is transferred from the drive gear to the tool carrier as the screwdriving operation begins. As a result of the torque occurring during the screwdriving operation, the idler gear and the clutch element joined to the tool receptacle are pushed slightly apart until the straight catch flanks come into engagement with one another and positive entrainment is guaranteed. When the depth stop encounters the surface, the tool carrier with the tool receptacle and the screw move even further until the latter is completely driven in. The cam elements of the first cam clutch then slide apart, assisted by the compression spring, until it releases. Because the torque has now decreased to zero, the idler gear is pressed by the compression spring against the second clutch element that is joined to the tool receptacle, so that the drive gear can continue to rotate freely without touching the idler gear. A "noiseless" shutoff is thus accomplished.

Also known are various screwdrivers which provide for a disconnection of the drive train by means of a shutoff system as soon as a preset torque is reached (cf., for example, EP 0 239 670 B1).

It is also known, in the case of a screw machine tool, to implement selectably a switchover capability between a shutoff by way of a depth stop and a shutoff by way of a preset torque (EP 0 401 548 B1). If this screwdriver is used for shutoff with a depth stop, the construction and operation then correspond in principle to the aforementioned U.S. Pat. No. 4,655,103.

By way of a spring-loaded coupling ring that is activated via pins upon removal of the depth stop and that covers the intermediate ring and the second clutch element facing the tool drive shaft, the intermediate clutch element and the second clutch element are pressed toward one another, when the depth stop has been removed, under the action of the spring, and are positively joined to one another via a spline set, so that these two elements act like a single clutch element even when acted upon by torque. What therefore results in this position, in combination with the oblique cam surfaces of the drive gear, is a cam clutch that releases at a torque that is preset by way of a corresponding adjustment mechanism.

Even after release, however, this clutch continues to run and "chatter."

SUMMARY OF THE INVENTION

It is therefore an object of the invention to provide a power-driven screwdriver with depth stop in which selectably either a shutoff via depth stop or a torque-dependent shutoff is provided for, and in either case no chattering of the shutoff clutch occurs.

This and other objects are achieved according to the present invention in a screwdriver of the type cited initially, in that

- a throwout ring, which is mounted on the tool drive shaft against a resistance, is provided;
- the first spring element is arranged between the cam ring and the throwout ring in order to preload the cam ring in the direction toward the drive gear;
- a second spring element, supported on the housing side, is provided on the side of the drive gear facing away from the first cam elements;
- first claw elements, which coact with second claw elements on the throwout ring in order to form a disconnect clutch, are provided on the second side of the cam ring.

The object of the invention is completely achieved in this fashion.

Both when a depth stop is used and when the depth stop has been removed, at the completion of a screwdriving operation a disconnection of the drive shaft from the tool drive shaft is accomplished, thus ensuring that no chattering occurs even if the drive motor continues to run.

In a preferred embodiment of the invention, the throwout ring is fastened on the tool drive shaft nonrotatably and in axially displaceable fashion toward the resistance. In addition, a locking means is provided in order to hold the throwout ring in a position slid forward axially toward the tool receptacle when the throwout ring shifts axially toward the tool receptacle during operation under load, and to disengage the throwout ring again after release of the disconnect clutch and subsequent pressure release.

According to a development of the invention, an axial stop against which is supported a third spring element, against which the throwout ring can be axially displaced toward the tool receptacle, is provided on the tool drive shaft.

With this kind of arrangement of a spring element, disengagement of the locking means that is locked in the slid-forward position can easily be achieved after release of the disconnect clutch and subsequent pressure release.

According to a further embodiment of the invention, the first spring element is clamped between the cam ring and an axial stop of the tool drive shaft.

This type of arrangement of the first spring element enhances the function of the entrainment clutch.

In a further preferred embodiment of the invention, the tool drive shaft is guided in axially displaceable fashion on the drive shaft with one end.

This simplifies mounting of the tool drive shaft.

In a preferred development of the invention, the locking means is configured as a ball catch that is lockable by way of a fourth spring element that is arranged between the tool drive shaft and the drive shaft.

This makes it possible to utilize the relative motion between the tool drive shaft and drive shaft to easily immobilize the throwout ring in a position that is axially slid forward toward the tool receptacle.

In an additional development of this embodiment, the locking means has axial guide lands on the tool drive shaft that coact with associated grooves on the throwout ring in order to guide the latter.

In an additional development of this embodiment, the axial guide lands are configured as lands, projecting outward from the tool drive shaft, whose first, tool-side, axial end serves to support the third spring element on its side facing toward the throwout ring, and whose second end, facing toward the throwout ring, serves to support the first spring element.

The construction, and the installation of the locking means and of the associated spring elements on the tool drive shaft, can thereby be simplified.

It is preferred in this context if a plurality of balls, which can be acted upon via a central ball by the fourth spring element in order to lock the throwout ring, are movably guided in transverse bores of the tool drive shaft.

In an additional development of this embodiment, the tool drive shaft has on the side toward the drive shaft a central bore in which the drive shaft is axially displaceably guided with a first end.

In this context, a blind hole in which a first end of the fourth spring element is received can be provided at the first end of the drive shaft, a second end of the fourth spring element resting against the central ball that is guided in axially displaceable fashion in the bore.

These features guarantee reliable operation of the locking means, and at the same time ensure a simplified design.

In an additional development of the invention, the second spring element is configured as a cup spring that is supported between the drive gear and an axial stop on the side of the drive gear facing away from the tool receptacle.

Configuring the second spring element as a cup spring makes it possible to achieve a relatively large spring force with a spring element of small physical size, so as thereby to ensure a large adjustment range for the release torque in the case of torque shutoff.

In a preferred development of the invention, the depth stop is mounted removably on the housing.

Although the depth stop could also be made nonfunctional in other ways, this is a particularly simple way of allowing a changeover between shutoff via depth stop and torque shutoff.

In an additional development of the invention, an adjusting sleeve is provided for axial adjustment of the intermediate ring toward the drive gear.

It is thereby possible to modify the release torque of the release clutch in simple fashion by modifying the overlap between the cam elements of the intermediate ring and of the drive gear.

For this purpose, in an additional development of this embodiment, a snap ring, which is fastened rotatably with respect to the housing and can be snap-locked in various angular positions, is fastened on the adjusting sleeve in axially displaceable fashion and nonrotatably with respect thereto.

It is thereby possible to achieve, in simple fashion, a simple axial adjustment of the adjusting sleeve with respect to the housing, together with snap-locking in various angular positions, if the adjusting sleeve is joined to the housing via threads.

In a preferred development of the invention, the catch elements on the cam ring and on the intermediate ring are configured as straight flanks, extending in the axial direction, at the outer end of the third and fourth cam elements.

It is thereby possible to achieve, with simple means, a positive entrainment for power transfer from the intermediate ring to the cam ring. Other connections would, however, theoretically also be conceivable, for example the use on one of the two rings of curved surfaces on which, for example, a transverse pin on the other of the two rings is guided.

In an advantageous development of the invention, the spring elements are coordinated with one another in such a way that after a shutoff of the screwdriver and subsequent pressure release, the locking means is unlocked again and pushed back into its starting position.

In a further embodiment of the invention, the first and second claw elements are furthermore configured as claws having straight surfaces running in the axial direction, or as cams having oblique surfaces that are more steeply sloped, with respect to the axial direction, than the first through fourth cam elements.

These features allow a simple configuration and manufacture of the relevant cam elements, catch elements, and claw elements.

In a further embodiment of the invention, the first, second, third, and fourth cam elements are configured as oblique cam surfaces, the slope of the first and second cam elements being greater than the slope of the third and fourth cam elements so as to guarantee, under load, that the cam ring is first displaced toward the throwout ring before, at greater torque, any displacement of the drive gear occurs.

Reliable operation in combination with simple manufacture and assembly can be achieved with a configuration of this kind.

It is understood that the features mentioned above and those yet to be explained below can be used not only in the respective combinations indicated, but also in other combinations or in isolation, without leaving the context of the present invention.

SHORT DESCRIPTION OF THE DRAWINGS

Figure 2A:
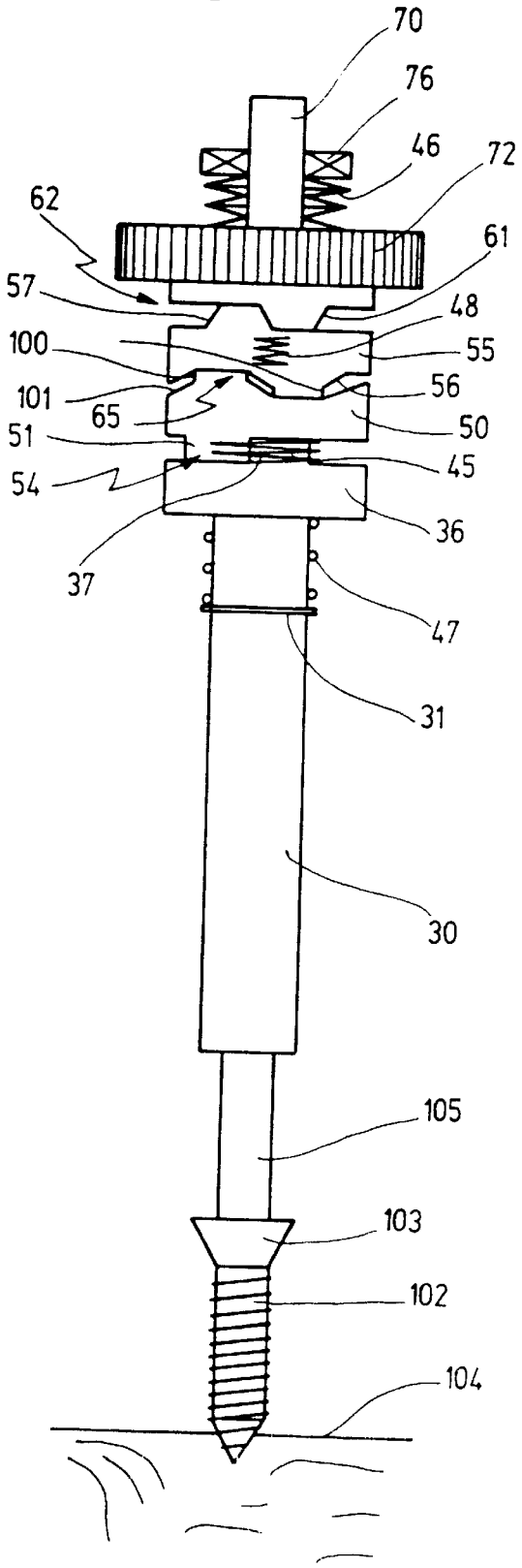
Figure 2B:
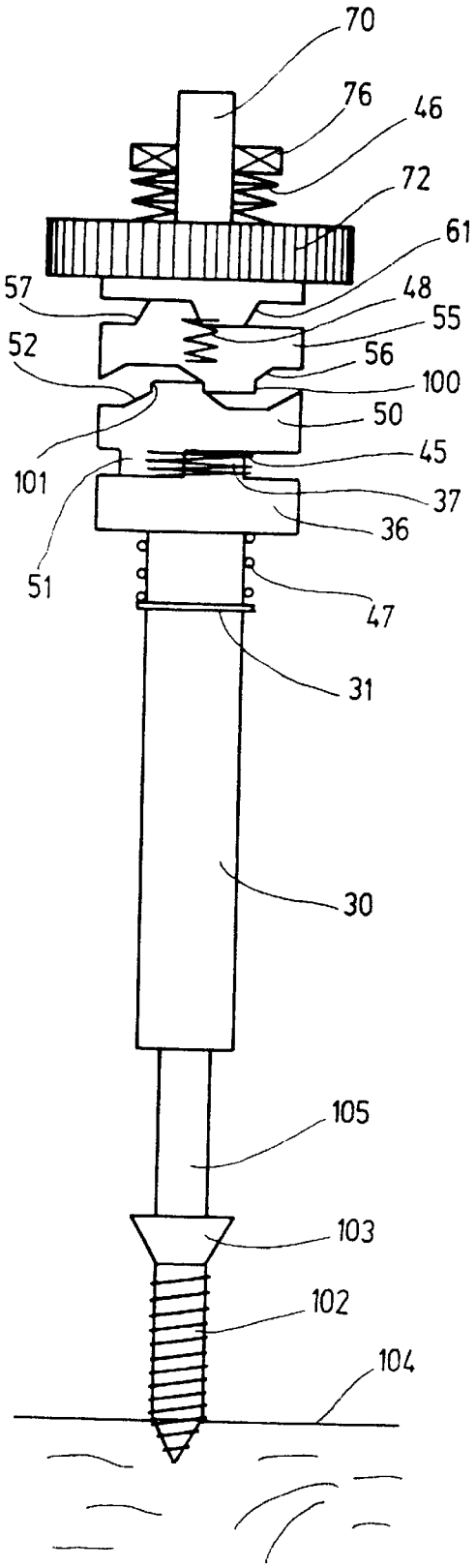
Figure 2C:
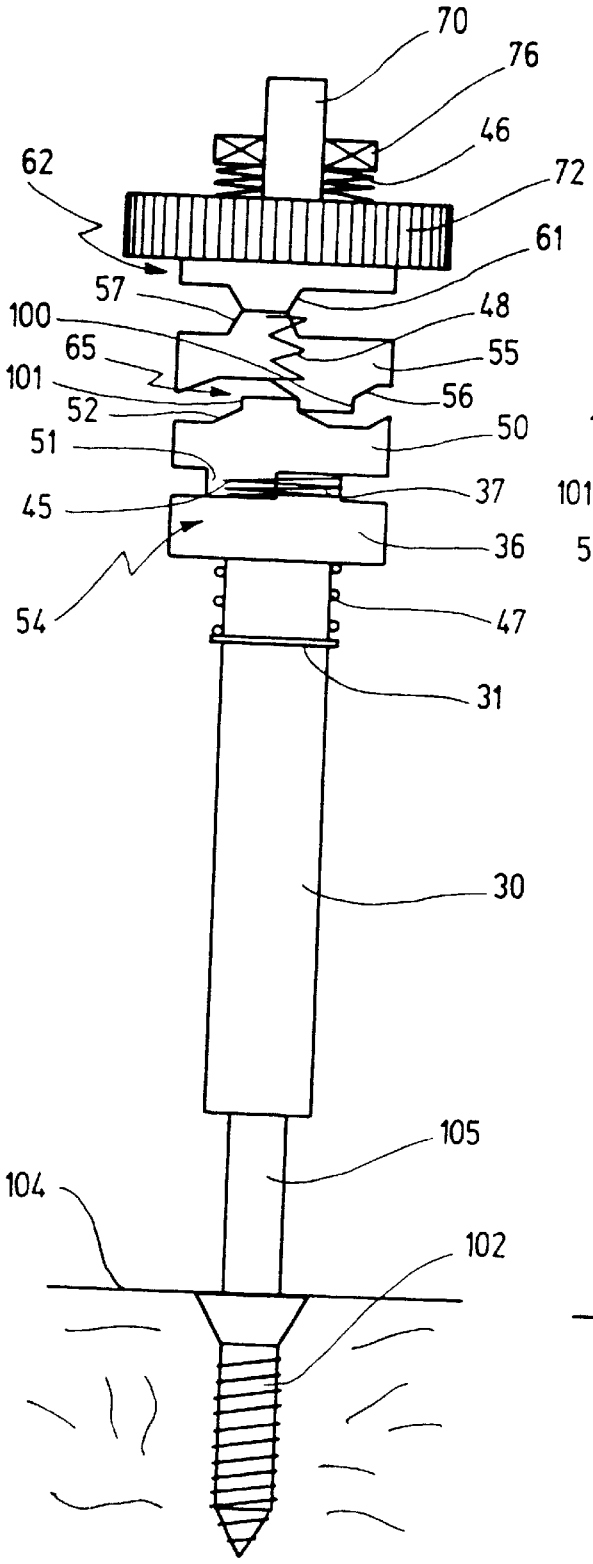
Figure 2D:
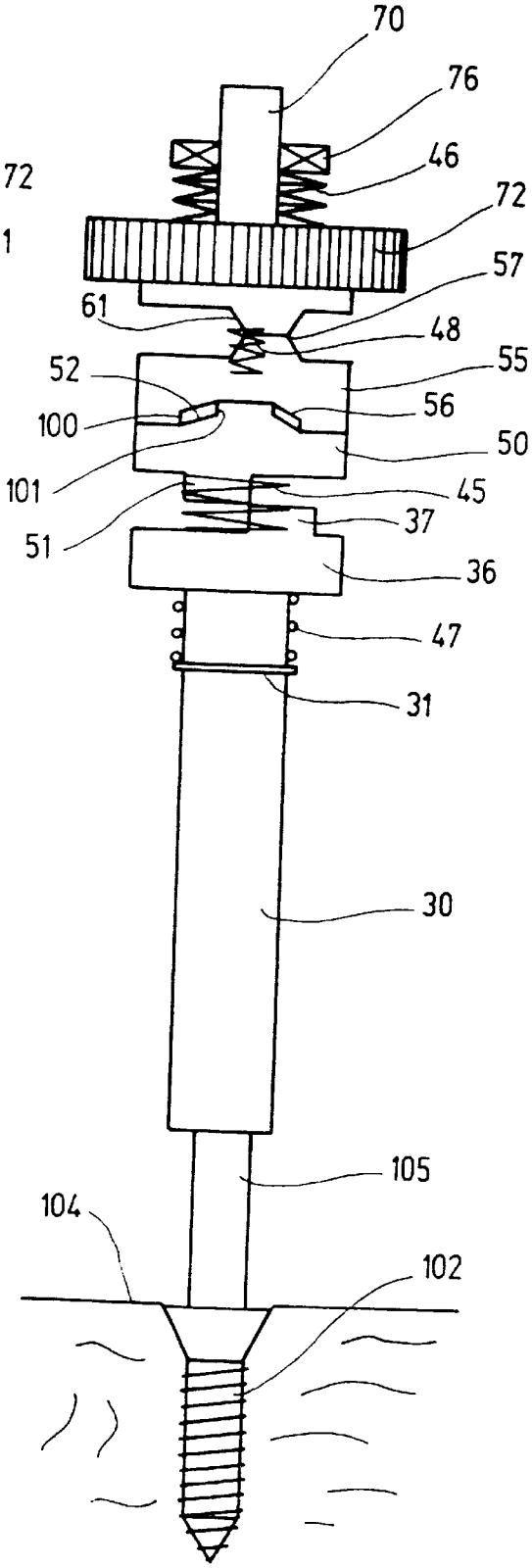
Figure 3A:
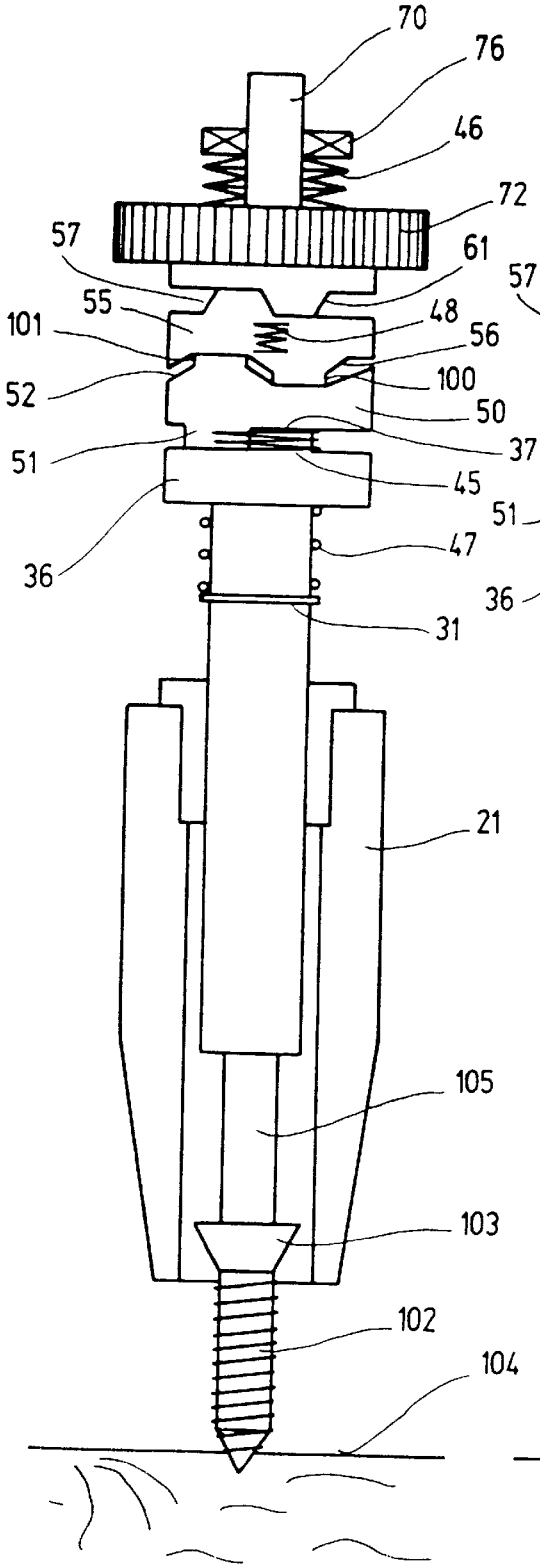
Figure 3B:
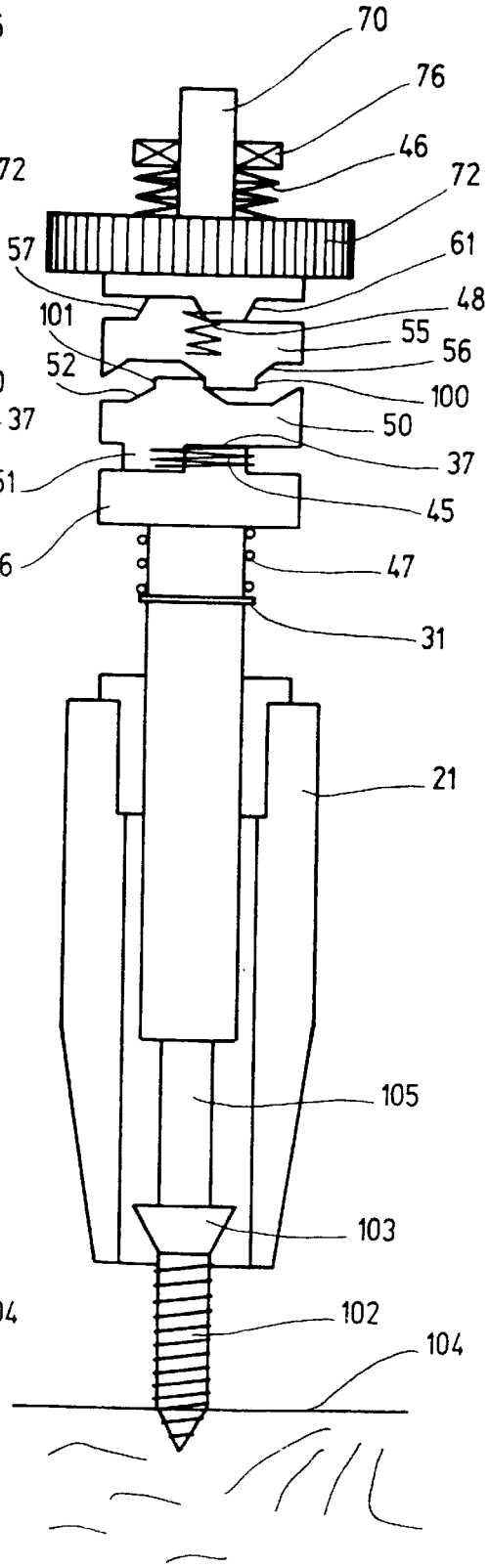
Figure 3C:
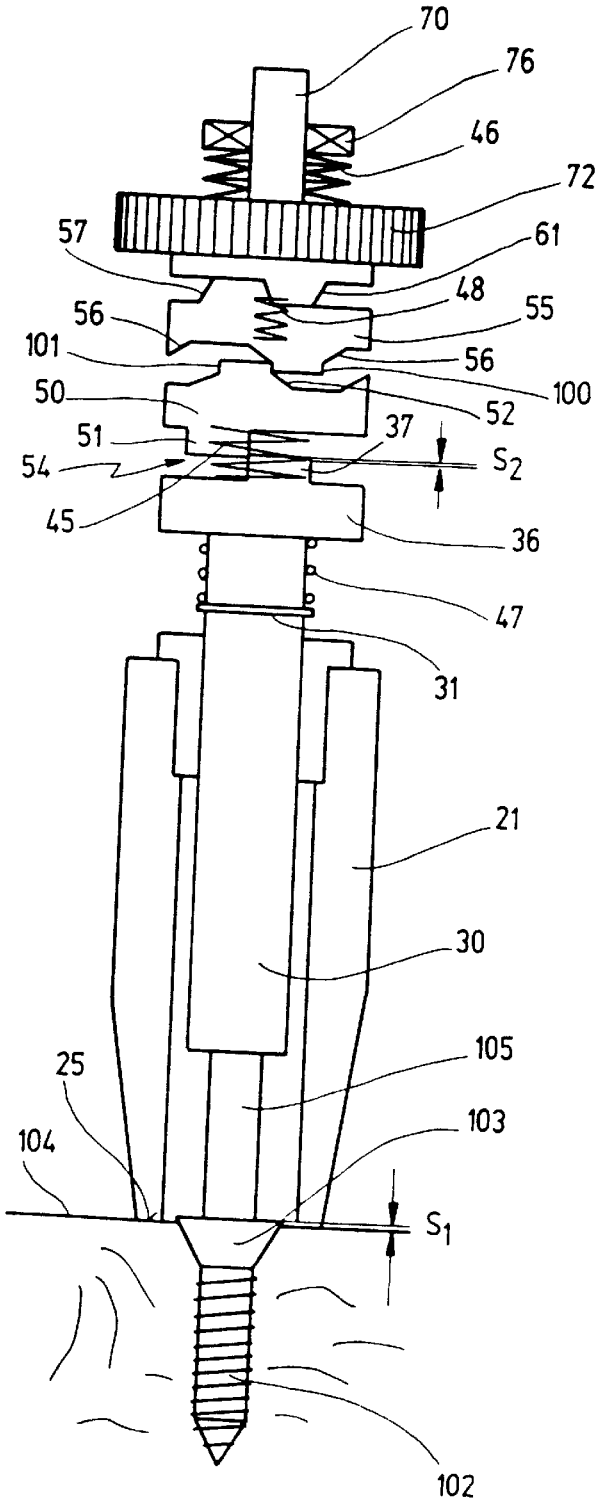
Figure 3D:
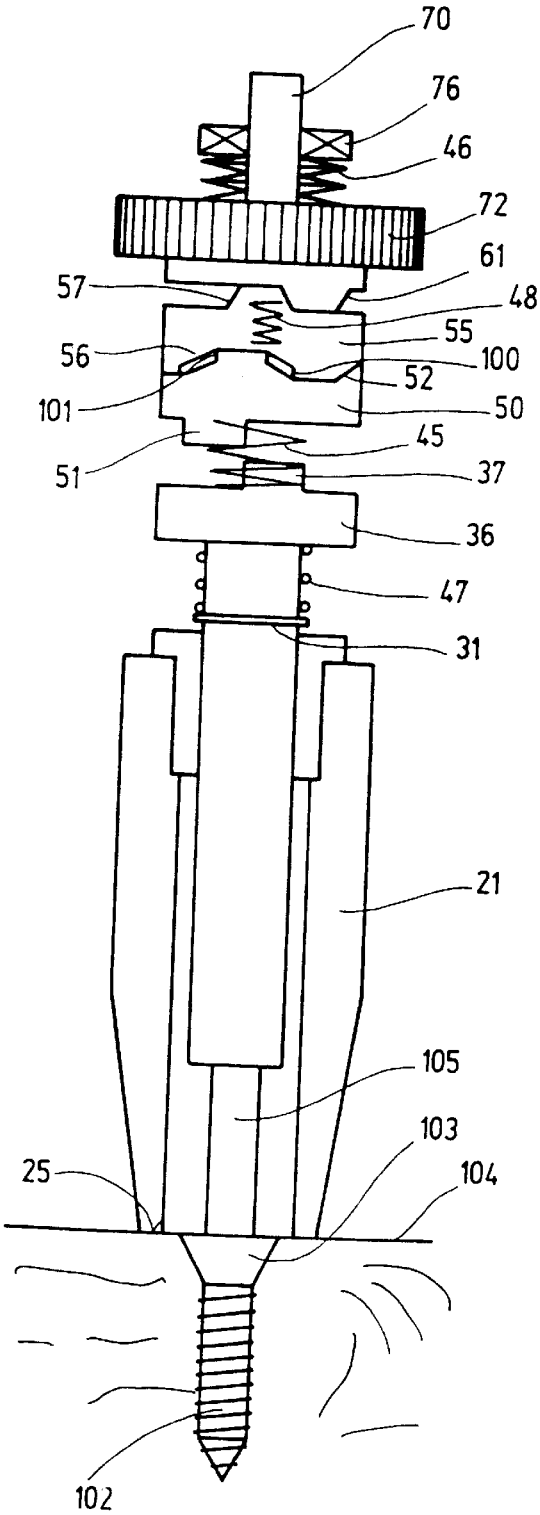

Further features and advantages of the invention are evident from the following description of preferred exemplary embodiments, referring to the drawings, in which:

FIG. 1 shows a partial longitudinal section through a screwdriver according to the present invention;

FIGS. 2*a*–2*d* show schematic representations of the operation of the screwdriver according to the present invention with the use of torque shutoff, in a greatly simplified manner of representation, in which:

FIG. 2*a* shows the screwdriver being manually placed and pressed onto a screw;

FIG. 2*b* shows the position established, during the screwdriving operation, as a consequence of a certain baseline torque;

FIG. 2*c* shows release of the release clutch when the preset torque is reached;

FIG. 2*d* shows the release of the disconnect clutch that occurs as a result of the decreased torque, thus allowing continued rotation without chattering;

FIGS. 3*a*–3*d* show schematic representations of the screwdriver according to the present invention with the use of the depth stop, in a greatly simplified representation, in which:

FIG. 3*a* shows the screwdriver being placed on a screw;

FIG. 3*b* shows the position established, during the screwdriving operation, as a consequence of the baseline torque;

FIG. 3*c* shows the depth stop encountering the surface into which the screw is to be driven; and FIG. 3*d* shows the response of the disconnect clutch, thus allowing continued rotation without chattering.

DETAILED DESCRIPTION OF THE PREFERRED EMBODIMENTS

In FIG. 1, a screwdriver according to the present invention is labeled in its entirety with the number 10.

Screwdriver 10 comprises a housing 11 in which is received a motor (not shown) which drives, via a pinion 74, a drive gear 72 having its teeth 73 meshing therewith. Further parts of the drive train thus constituted are not shown. Drive gear 72 is mounted on a drive shaft 70 that is aligned with a tool drive shaft 30 on whose outer end is provided a tool receptacle 26, for example to receive a screwdriver bit.

The torque of drive gear 72 can be transferred via an intermediate ring 55 and a cam ring 50 to a throwout ring 36 that is fastened on tool drive shaft 30 in nonrotatable and axially displaceable fashion.

Tool drive shaft 30 is displaceable in the direction of its rotation axis 27 with respect to drive shaft 70. For this purpose, there is provided on the end of tool drive shaft facing toward drive shaft 70 a central bore 41 with which tool drive shaft 30 is guided in axially displaceable fashion on the end of drive shaft 70.

Intermediate ring 55 is mounted in freely rotatable fashion on tool drive shaft 30 and drive shaft 70. Cam ring 50 is also arranged in freely rotatable fashion on tool drive shaft 30, between intermediate ring 55 and throwout ring 36. Throwout ring 36, on the other hand, is mounted in axially displaceable but nonrotatable fashion on axial guide lands 33 on the outer side of tool drive shaft 30, which are configured as external lands, in the manner of a wedge profile, that engage into correspondingly shaped grooves on throwout ring 36. Arranged on drive gear 72, on the side facing toward intermediate ring 55, are cam elements 61 having oblique cams of the kind known from U.S. Pat. No. 4,655,103. Correspondingly shaped second cam elements 57, which are provided on intermediate ring 55, engage into these first cam elements 61. These interengaging oblique cam flanks thus form a release clutch that is labeled in its entirety with the number 62.

Drive gear 72 is retained by a retaining ring 71 in the direction toward tool receptacle 26, and is preloaded on the other side by way of a spring element 46 in the form of a cup spring that hereinafter will be referred to as the second spring element. The cup spring is also retained by a retaining ring 75, and is supported at the end facing away from drive gear 72 by an axial bearing 76 that is received on housing 11. Drive shaft 70 is furthermore mounted at this end in housing 11, in a radial bearing 77 that is configured as a plain bearing.

Intermediate ring 55 forms, together with cam ring 50, an entrainment clutch that is labeled in its entirety with the number 65. Entrainment clutch 65 has third cam elements 56 in the form of oblique cam surfaces, associated with which are fourth cam elements 52 of corresponding shape on cam ring 50. Catch elements 100 and 101, whose shape is evident from FIGS. 2*a* through 2*d,* are provided at the end of these oblique cam surfaces associated with the respective other part. First catch elements 100 are in the form of straight, axially parallel flanks at the outer end of the oblique cam elements 56 on the intermediate ring, and the corresponding catch elements 101 are in the form of straight flanks at the end of the oblique cam elements 52 of cam ring 50.

Cam elements 52, 56 and catch elements 100, 101 thus form entrainment clutch 65, with which cam ring 50 is entrained by intermediate ring 55; when a certain baseline torque occurs, an axial displacement occurs until catch elements 100, 101 engage positively into one another.

Also constituted, between cam ring 50 and throwout ring 36, is a disconnect clutch, labeled in its entirety with the number 54, which comprises first claw elements 51 with straight, axially parallel flanks on cam ring 50, and second claw elements 37 with correspondingly shaped straight flanks on throwout ring 36.

Axial guide lands 33 on tool drive shaft 30 have a first, tool-side end 34 and a second end 35 facing toward drive gear 72. Arranged between second end 35 and cam ring 50 is a first spring element 45 in the form of a helical spring, surrounding tool drive shaft 30, which preloads tool drive shaft 30 in a direction facing away from cam ring 50. Second spring element 46 in the form of the cup spring is, as already mentioned, arranged between drive gear 72 and a radial bearing 77.

A third spring element 47, which is also configured as a helical spring surrounding the tool drive shaft, is clamped between the first, tool-side end 34 of axial guide lands 33 and axial stop 31, in order to preload throwout ring 36 toward drive gear 72.

Throwout ring 36 can be locked, by way of a locking means that is labeled in its entirety with the number 43, in a position that is slid forward against the force of third spring element 47 toward tool receptacle 26, thereby preventing throwout ring 36 from sliding back toward drive gear 72. This locking means is configured as a ball catch that has a total of three small balls 39 that are guided in the radial direction in transverse bores of tool drive shaft 30, and has one central large ball 40 that is preloaded, by a fourth spring element 48 that is received in a blind hole 49 on the tool-side end of drive shaft 70, toward tool receptacle 26 and toward small balls 39 that are guided in transverse bores 38. Bore 41 is prolonged at the tool-side end, in the direction of tool receptacle 26, by a blind hole 32, such that a smaller diameter of blind hole 32 constitutes a seating surface 42 for precisely fitted reception of central ball 40.

Small balls 39 are preloaded via central ball 40 outward in the radial direction by the force of fourth spring element 48. If throwout ring 36 is then moved toward tool receptacle 26 sufficiently far that small balls 39 are no longer prevented by the inner surface of throwout ring 36 from emerging outward, small balls 39 can then, in response to the spring force of fourth spring element 48, move outward into radial bores 38 until they are prevented from emerging further by second claw elements 37, arranged above them, of throwout ring 36. In this position, throwout ring 36 is prevented from moving back toward drive gear 72. This locking action remains effective until fourth spring element 48 is unloaded, so that small balls 39 move back, in response to third spring element 47, into their radial bores 38, so that throwout ring 36 is disengaged and moves toward drive gear 72 in response to third spring element 47 and against the force of first spring element 45.

The release torque of release clutch 62, which is constituted by the cam elements of drive gear 72 and of intermediate ring 55, of course depends on the shape and especially on the flank angle of cam elements 57, 61. The release torque is also influenced by the spring constant and length of second spring element 46.

A variety of measures are conceivable for achieving easy adjustment of the release torque. A particularly simple design results if only the overlap of the flanks of first cam elements 61 and of second cam elements 57 is modified. For this purpose, intermediate ring 55 can be adjusted in the direction of drive gear 72 with the aid of an adjusting sleeve, by way of a radial bearing 60 that is enclosed between retaining rings 58, 59 on intermediate ring 55 and adjusting sleeve 13 that is fastened to the housing. Adjusting sleeve 13 is joined via threads 12 to housing 11, and can thus be adjusted in the axial direction by rotation.

In order to make possible manual adjustment from outside, a snap ring 14 is provided that can be pulled toward tool receptacle 26 against the force of a helical spring 18 and is joined nonrotatably, via an axial guide 17, to adjusting sleeve 13. Provided on the housing-side end of snap ring 14, in the circumferential direction, is a plurality of snap lugs 15 that can be snapped in various angular positions in between corresponding recesses on housing 11 in order thereby to immobilize snap ring 14 in nonrotatable fashion in a desired angular position. To rotate adjusting sleeve 13, all that is therefore necessary is for snap ring 14 to be pulled, against the force of helical spring 18, toward tool receptacle 26 and then rotated, and finally it is once again held in a new predefined angular position, in a manner secured against further rotation, by snap lugs 15. Helical spring 18 is enclosed in a suitable hollow cylindrical recess of snap ring 14 and held at the outer end of snap ring 14 by a retaining ring 16 that is fastened on a sleeve 19 that is immovably press-joined in this region to tool drive shaft 30. Inner retaining ring 16 is immobilized in the axial direction, after the installation of helical spring 18 on sleeve 19, by way of a further preceding retaining ring 20.

The depth stop labeled in its entirety with the number 21 is a depth stop of known design, for example in accordance with EP 0 401 548 B1, that can simply be slid onto the outer end of sleeve 19 until it rests against retaining ring 16. A recessed O-ring 24 provides immobilization. Depth stop 21 is configured as a multi-part plastic part in which threads 22 allow axial adjustment of end surface 25 at the outer end of the depth stop. An inner adjusting sleeve 28 of the depth stop can be immobilized in snap-locked fashion in various angular positions with respect to an outer stop sleeve 29 of depth stop 21, for which purpose two balls 29*a* are provided that engage in various angular positions, under the action of elastic O-rings 23, into correspondingly shaped grooves on stop sleeve 29.

As already mentioned, depth stop 21 can be pulled off as a unit from sleeve 19.

The manner of operation of the screwdriver, with the depth stop pulled off and with noiseless torque-dependent shutoff, will be explained below with reference to FIGS. 2*a* through 2*d*. The manner of operation of the screwdriver with depth stop 21 in place will then be explained with reference to FIGS. 3*a* through 3*d*.

A tool 105 in the form of a screwdriver bit is inserted, for example, into the tool receptacle in order to drive a screw 102 into a surface 104.

With the depth stop removed, the screwdriver is first, as shown in FIG. 2*a,* placed with tool 105 onto head 103 of screw 102 and pressed down, so that both release clutch 62 and entrainment clutch 65 and disconnect clutch 54 are closed, so that when the machine is subsequently switched on, torque can be transferred from drive gear 72 to tool drive shaft 30, and screw 102 can thus be driven in.

After switching on, the position shown in FIG. 2*b* is established during the screwdriving operation, since because of the relatively shallow slope of cam elements 52, intermediate ring 55 and cam ring 50 slide out of one another until ultimately catch elements 100, 101 come into engagement, thus ensuring positive entrainment of cam ring 50 by intermediate ring 55. At the same time, cam ring 50 is displaced, in response to the pressure and torque, sufficiently far toward tool 105 that throwout ring 36 is held in its slid-forward position by locking means 43.

In FIG. 2*a,* first spring element 45 is compressed between cam ring 50 and throwout ring 36, third spring element 47 is in an extended position, and fourth spring element 48 is compressed.

In the position according to FIG. 2*b,* third spring element 47 is somewhat shortened by the slid-forward throwout ring 36, and first spring element 45 is still compressed, while fourth spring element 48 is somewhat elongated by the slid-forward cam ring 50.

When screw 102 has been practically completely driven into surface 104, the torque rises sharply toward the end of the screwdriving operation, so that the release torque of release clutch 62 is overcome and drive gear 72 is displaced, against the force of second spring element 46, until cam elements 57, 61 (as shown in FIG. 2*c*) come out of engagement and the torque being transferred thus decreases to a value of zero. As a consequence, cam ring 50 is displaced in response to first spring element 45 toward intermediate ring 55, so that disconnect clutch 54 releases, thus resulting in the position according to FIG. 2*d,* in which cam ring 50 and intermediate ring 55, together with drive gear 72, can continue to rotate but claw elements 51 of cam ring 50 and claw elements 37 of throwout ring 36 cannot come into engagement, this being ensured by the fact that throwout ring 36 is locked in the slid-forward position.

When the screwdriving operation is then terminated and axial pressure on the screwdriver is released, fourth spring element 48 thus relaxes, which results in disengagement of locking means 43. Since the spring force of fourth spring element 48 is now less than the spring force of third spring element 47, throwout ring 36 is pushed back into its starting position and disconnect clutch 54 is thus "loaded."

A new screwdriving operation can now begin.

When working with the depth stop in place, what first results—as shown in FIG. 3*a*—when the screwdriver is placed with tool 105 on the head of screw 103 is a position in which, as in FIG. 2*a,* drive gear 72, intermediate ring 55, cam ring 50, and throwout ring 36 are pressed together, so that when the machine is then switched on, a torque is transferred to tool 105.

When the machine is switched on, cam ring 50 once again moves (as shown in FIG. 3*b*) in response to the torque toward throwout ring 36, the latter simultaneously being locked in a position that is slid forward toward tool 105.

When depth stop 21 then encounters surface 104 with its end surface 25, shortly before screw 102 is completely driven in, tool drive shaft 30 continues to follow screw 102 that is being driven in. As screw head 103 is countersunk, claw elements 37, 51 come out of engagement so that the torque briefly decreases. First spring element 45 now pushes cam ring 50 toward intermediate ring 55, so that disconnect clutch 54 is completely disconnected and even continued rotation of the drive train does not cause chattering, since the distance between claw elements 37 and 51 has been sufficiently increased by the backward movement of cam ring 50 along oblique cam elements 52, 56.

This situation is shown in FIG. 3*d.*

FIG. 3*c* shows the situation, shortly before the release of disconnect clutch 54, in which there is still a certain overlap (labeled $S_2$) between claw elements 37, 51 while screw head 103 can still be driven in a corresponding amount that is labeled $S_1$. As soon as overlap $S_2$ becomes zero, disconnect clutch 54 releases; this then results in noiseless disconnection as already described.

The spring constants and length of spring elements 45, 47 and 48 should advantageously be coordinated with one another. Correspondingly, the shape and arrangement of the cam elements and catch elements should be coordinated with one another. In this context, cam elements 52, 56 should have less of a slope than cam elements 57, 61 in order to allow cam ring 50 to move forward toward throwout ring 36 before release clutch 62 releases.

If the screwdriver is used with the depth stop, then preferably release clutch 62 is set to a high release torque so that torque-dependent shutoff does not occur before shutoff by way of the depth stop has been achieved.

What is claimed is:

1. A power-driven screwdriver comprising:

a housing comprising means for receiving a depth stop;

a tool drive shaft, arranged axially displaceably within said housing and having a first and a second end;

a tool receptacle arranged at said first end of said tool drive shaft;

a drive shaft;

a motor-driven drive gear, arranged on said drive shaft rotatably and axially displaceable, said drive gear having a first side facing toward said tool receptacle, and having a second side opposite said first side;

an intermediate ring mounted rotatably on said drive shaft and having a first side facing toward said drive gear, and a second side;

a cam ring mounted rotatably on said tool drive shaft and having a first side facing toward said intermediate ring, and a second side;

first cam elements arranged on said drive gear and coacting with second cam elements arranged on said first side of said intermediate ring;

third cam elements arranged on said second side of said intermediate ring and coacting with associated fourth cam elements arranged on said cam ring;

first catch elements arranged on said intermediate ring;

second catch elements arranged on said cam ring and coacting with said first catch elements;

a throwout ring mounted on said tool drive shaft axially displaceably against a resilient means;

a first spring element arranged between said cam ring and said throwout ring for preloading said cam ring in a direction toward said drive gear;

a second spring element, supported between the housing and said second side of said drive gear;

first claw elements, arranged on said throwout ring; and second claw elements arranged on said second side of said cam ring and coacting with said first claw elements.

2. The screwdriver of claim 1, wherein said throwout ring is arranged nonrotatably on said tool drive shaft.

3. The screwdriver of claim 2, further comprising a locking means for locking said throwout ring in a position slid forward axially toward said tool receptacle, when shifted axially toward said tool receptacle during operation under load, and for disengaging said throwout ring after disengaging said first from said second claw elements.

4. The screwdriver of claim 3, further comprising an axial stop provided on said tool drive shaft, and wherein said resilient means is configured as a third spring element which is supported by said axial stop at one end thereof and by said throwout ring at another end thereof.

5. The screwdriver of claim 4, wherein said first spring element is held between said cam ring and said axial stop of said tool drive shaft.

6. The screwdriver of claim 5, wherein said locking means is configured as a ball catch that is lockable by way of a fourth spring element that is arranged between said tool drive shaft and said drive shaft.

7. The screwdriver of claim 3, wherein said first, second, third and fourth spring elements are coordinated with one another in such a way that after a shutoff of the screwdriver and subsequent pressure release, the locking means is unlocked again and pushed back into its original position.

8. The screwdriver of claim 7, wherein said first, second, third, and fourth cam elements have oblique cam surfaces, the slope of the cam surfaces of the first and second cam elements being greater than the slope of the third and fourth cam elements.

9. The screwdriver of claim 1, wherein said tool drive shaft is guided at one end thereof axially displaceably on said drive shaft.

10. The screwdriver of claim 9, wherein said locking means further comprises axial guide lands arranged on said tool drive shaft coacting with associated grooves arranged on said throwout ring for guiding the latter.

11. The screwdriver of claim 10, wherein said axial guide lands are configured as lands, projecting outward from the tool drive shaft, wherein said first end of said tool drive shaft supports said third spring element on a side facing toward the throwout ring, and wherein said second end of said tool drive shaft supports said first spring element on a side facing toward the throwout ring.

12. The screwdriver of claim 11, wherein said locking means further comprises a plurality of transverse bores arranged within said tool drive shaft for guiding a plurality of balls therein, and further comprises a central ball for locking said plurality of balls within said transverse bores, when said central ball is shifted axially by said fourth spring element acting on said central ball.

13. The screwdriver of claim 12, wherein said tool drive shaft comprises a central bore within which said drive shaft is axially displaceably guided at a first end thereof.

14. The screwdriver of claim 13, wherein said drive shaft comprises at its first end a blind hole in which a first end of said fourth spring element is received, and wherein a second end of said fourth spring element rests against said central ball that is guided in axially displaceably fashion within said bore of said tool drive shaft.

15. The screwdriver of claim 1, wherein said second spring element is configured as a cup spring that is supported between said drive gear and an axial stop arranged on a side of said drive gear facing away from said tool receptacle.

16. The screwdriver of claim 1, wherein said depth stop is mounted removably on said housing.

17. The screwdriver of claim 1, further comprising an adjusting sleeve allowing axial adjustment of said intermediate ring toward said drive gear.

18. The screwdriver of claim 17, wherein said adjusting sleeve further comprises a snap ring, which is fastened axially displaceably and nonrotatably thereon, which is rotatable with respect to said housing, and which comprises means for snap-locking with said housing in a plurality of angular positions.

19. The screwdriver of claim 1, wherein said catch elements are configured as straight flanks, extending in axial direction, at an outer end of said third and fourth cam elements.

20. The screwdriver of claim 1, wherein said first and second claw elements are configured as claws having straight surfaces extending axially.

21. The screwdriver of claim 1, wherein said first and second claw elements are configured as cams having oblique surfaces that are more steeply sloped, with respect to an axial direction, than said first, second, third and fourth cam elements.

* * * * *